United States Patent [19]

Kamp

[11] 4,295,024

[45] Oct. 13, 1981

[54] SPRING BIASED ENERGY ABSORBER FOR VACUUM SWITCH CONTACT SHAFTS

[75] Inventor: Eugene L. Kamp, Fulton, Mo.

[73] Assignee: A. B. Chance Company, Centralia, Mo.

[21] Appl. No.: 78,094

[22] Filed: Sep. 24, 1979

[51] Int. Cl.[3] ..... H01H 3/60

[52] U.S. Cl. ..... 200/288; 200/67 PK; 200/245

[58] Field of Search ..... 200/67 B, 67 R, 67 PK, 200/153 G, 288, 245, 76; 335/46, 193

[56] References Cited

U.S. PATENT DOCUMENTS

| | | | |
|---|---|---|---|
| 1,452,472 | 4/1923 | Plehaty | 200/288 |
| 3,129,308 | 4/1964 | Yokoyama et al. | 200/288 |
| 3,165,608 | 1/1965 | Wallace | 200/288 |
| 3,337,703 | 8/1967 | Yamada | 200/288 |
| 3,529,111 | 9/1970 | Lupish et al. | 200/288 |
| 3,562,454 | 2/1971 | Chance | 200/67 B |

*Primary Examiner*—John W. Shepperd

*Attorney, Agent, or Firm*—Schmidt, Johnson, Hovey & Williams

[57] ABSTRACT

An improved electrical switch unit is provided having a strategically located, shock-absorbing member which absorbs a large proportion of potentially damaging impact forces developed during switch closing operations and thus preserves the soft metal switch contact shafts against significant deformation and consequent alteration in the operational characteristics of the switch. The shock-absorbing function is advantageously performed by a low-mass, spring-biased weld break lever associated with the over toggle switch operating mechanism. During the switch closing sequence the contact-shifting operating arm of the switch operating apparatus engages the biased weld break lever and the latter serves to slow the relative closing speed of the contacts prior to the instant of impact therebetween; in this manner a significant amount of the impact forces are absorbed which would otherwise be absorbed by the contact shafts themselves.

4 Claims, 8 Drawing Figures

Brass Lever With Spring

Alum. Lever With Spring

SPRING BIASED ENERGY ABSORBER FOR VACUUM SWITCH CONTACT SHAFTS

BACKGROUND OF THE INVENTION

1. Field of the Invention

The present invention is concerned with an improved electrical vacuum switch which includes a spring-biased, shock-absorbing member for controlling the closing sequence of the switch in a manner to prevent significant, deleterious deformation of the soft metal contact shafts of the switch. More particularly, it is concerned with a switch of the type described in U.S. Pat. No. 3,562,454 wherein a low mass weld break lever is employed, in conjunction with a helical biasing spring, in order to provide a desirable shock-absorbing function while at the same time allowing the switch to be closed and opened in the usual fashion.

2. Summary of the Invention

Vacuum switches are well known and normally include a vacuum bottle which encloses a pair of separable contacts respectively supported by a stationary and shiftable shaft. In order to retain their electrical operating characteristics, such switches are formed of specialized materials and fabricated in ways to avoid formation or release of ionizable gases such as oxygen within the vacuum bottle. For example, it is common to use oxygen-free copper for the contact-supporting shafts, and to subject the bottle, shafts and contacts to a high temperature (1000° C.) degassing and brazing procedure during manufacture. While this technique greatly lowers the possibility of oxidation during manufacture and use of the switch, the high temperature process adversely affects the copper contact-supporting shafts and renders the same soft and deformable. As a result, opening and closing operations with the switches tends to deform and in effect shorten the contact shafts (by as much as ¼ inch); and this alteration drastically changes the operating characteristics of the switches.

U.S. Pat. No. 3,562,454 describes a vacuum-type electrical switch having a pair of separable contacts and an over toggle spring-operated opening and closing mechanism. In addition, the subject patent describes a weld break lever associated with the operating mechanism which assures opening of the switch contacts even in the event that the latter become welded together during use. In order to facilitate a description of the present invention, U.S. Pat. No. 3,562,454 is hereby expressly incorporated by reference into the instant specification.

The over toggle operating mechanism described in the above-referenced patent is extremely effective for quickly and positively opening and closing the associated switch contacts. As can be appreciated, it is desirable in switch units of this type to rapidly close and open the contacts so as to substantially eliminate arcing over or decomposition of the contacts themselves. By the same token however, it is known that switch contacts can be effectively welded together during use thereof, and unless some positive weld break feature is provided, the extremely dangerous situation can result wherein a lineman can trip open the switch actuating mechanism while the contacts themselves nevertheless remain in conductive engagement. In order to overcome this problem, U.S. Pat. No. 3,562,454 describes the use of a J-shaped auxiliary weld break lever which is pivotally mounted adjacent the over toggle mechanism and located for contact with the operating mechanism during the closing sequence. If the contacts are welded together, continued rotation of the operating arm of the switch acts, through the J-shaped lever, to positively break the weld and thus open the contacts.

Switches of the type described in U.S. Pat. No. 3,562,454 are normally provided with the soft copper contact shafts described above, and the problems of shaft deformation are present in these units.

In the past, the problem of shaft deformation has been partially alleviated by multiple openings and closings of newly manufactured switches prior to use thereof in the field. For example, it has been the practice to go through the total of 225 separate opening and closing operations in order to work harden the originally deformable contact shafts, and thereafter readjust the switch operating mechanism for proper opening and closing prior to shipping thereof.

Although this procedure largely solves the problem of shaft deformation, it will be appreciated that it is costly from a manufacturing standpoint. Moreover, in view of the fact that 225 opening and closing sequences is far in excess of the normal number of such sequences experienced by a switch during the useful lift thereof, it can be seen that the procedure represents a significant wear and tear on the switches, and that this occurs before the same ever go into actual use.

SUMMARY OF THE INVENTION

The present invention overcomes the problems outlined above by provision of an improved switch having structure for slowing the relative closing speed of the switch contacts prior to the instant of impact therebetween, so as to absorb a major proportion of the impact forces which are normally absorbed wholly by the contacts and supporting shafts. The invention thus allows closing of the contacts without significant deformation of the supporting shafts therefor. In practice, the weld break arm described in U.S. Pat. No. 3,562,454 is replaced with a low mass, aluminum version thereof, and a helical spring is provided for biasing the weld break lever in a direction for absorbing a high proportion of the impact force developed during the switch closing sequence and which is normally totally absorbed by the switch contacts. Of course, the invention also comprehends other equivalent means of energy absorption during the switch closing sequence.

The preferred operating mechanism used in the switch of the present invention is an over toggle, spring-actuated arrangement of the type described in U.S. Pat. No. 3,562,454.

DESCRIPTION OF THE PREFERRED EMBODIMENT

Figure 1:
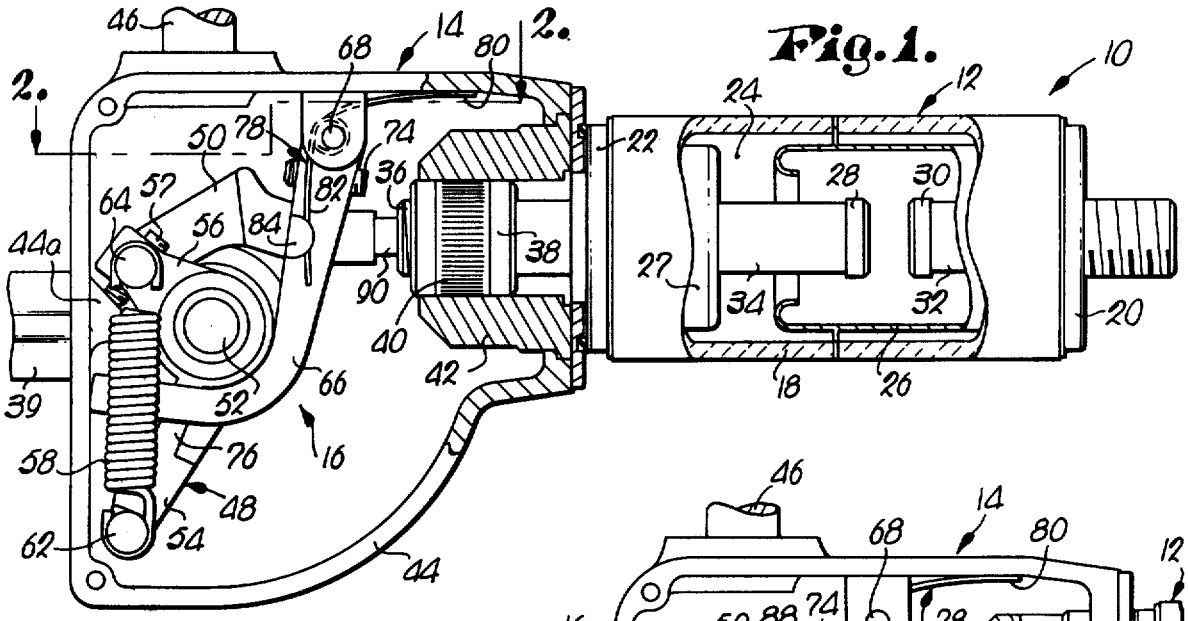
FIG. 1 is a view in partial vertical section and with parts broken away for clarity which illustrates the contacts of the switch as well as the switch-operating apparatus.

Turning now to the drawings, switch 10 in accordance with the invention broadly includes a vacuum bottle interrupter section 12, a conductive metal housing 14 attached to the section 12, and an operating apparatus 16 disposed within housing 14 and operably coupled to the interrupter section 12 as will be described. Though not illustrated, it is to be understood that switch 10 may be encapsulated within a waterproof, elastic jacket of high dielectric strength synthetic resin material.

The section 12 includes a hollow, ceramic, cylindrical tube 18 which is evacuated and sealed by means of end caps 20, 22 to present a negative pressure chamber 24. Hollow metallic housing 26 is located within the chamber 24 and surrounds a pair of metallic electric contacts 28, 30. Conventional bellows 27 are also disposed within the tube 18 for ensuring maintenance of vacuum conditions during switch opening and closing operations. The contact 30 is stationary and is supported within housing 26 by means of an oxygen-free, soft copper shaft 32 which projects through the end cap 20. An elongated shaft 34 likewise formed of soft, oxygen-free copper supports shiftable contact 28 within the housing 26 and is axially shiftable for opening and closing of the contacts 28, 30. In this respect it will be noted that the shafts 32, 34 are coaxially aligned within the housing 26.

The shaft 34 extends through end cap 22 and bellows 27 and is threaded as at 36 at the outermost end thereof. The threaded section 36 supports a sliding contact 38. The latter includes a conductive, louvered, annular band 40 having a series of transversely extending louvers each being canted relative to the nominal circumferential surface of the band 40.

The sliding contact 38 is reciprocably supported within an annular, metallic, stationary contact bushing 42 which is in turn conductively secured to the metallic housing 14. During the opening and closing operation of switch 10 to be described, the band 40 maintains a positive electrical contact with the stationary contact 42 irrespective of the position of the sliding contact 38.

The housing 14 includes an open metallic box 44 and a removable mating cover (not shown), and an inwardly extending abutment **44*a*. A connector 46 projects outwardly from one side of box 44 and provides a convenient electric coupling for placing the switch 10** in a circuit.

Figure 2:
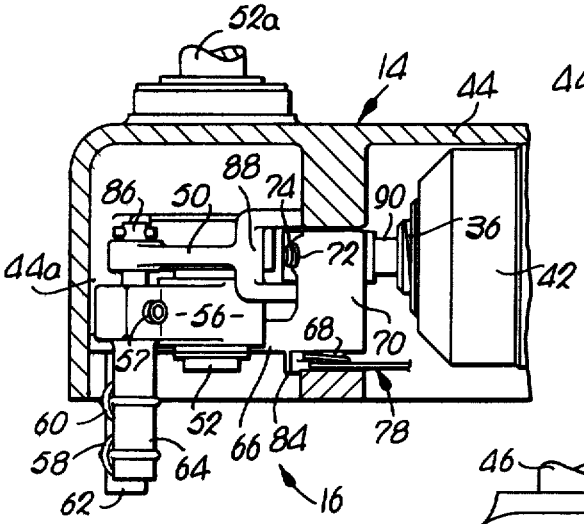
FIG. 2 is a sectional view taken along irregular line 2—2 of FIG. 1 which further illustrates the switch operating apparatus.

The apparatus 16 includes an over-toggle mechanism 48, as well as a connection arm 50 which operatively connects the mechanism 48 and the operating rod 34. The mechanism 48 includes a shaft 52 rotatably supported on a sidewall of a box 44, a crank 54 secured to shaft 52 for rotation therewith, and a toggle linkage 56 extending between the shaft 52 and the arm 50. As best seen in FIG. 2, shaft 52 extends outwardly beyond the sidewall of box 44 in the form of an extension **52*a*; and an actuating lever 39 is keyed to the extension 52*a* for manual operation of the switch 10**.

A pair of juxtaposed tension springs 58, 60 extend between connection shafts 62, 64 respectively connected to the crank 54 and link 56. The springs 58, 60, in the FIG. 1 (switch open) over center position of mechanism 48, exert a biasing force tending to pull the crank 54 and link 56 together; similarly, in the FIG. 5 (switch closed) over center position, the springs 58, 60 likewise bias crank 54 and link 56 together.

The operating apparatus 16 also includes a J-shaped weld break lever 66 which is pivotally mounted as at 68 on an end wall of the box 44. The lower part of the lever 66 as viewed in FIG. 1 is disposed in partial circumscribing relationship to the shaft 52 and toggle linkage 56. The lever 66 includes a laterally extending rigid boss portion 70 which is rotatable about pivot 68 and has a threaded aperture 72 therein which receives an adjusting screw 74. A laterally protruding ear (not shown) is provided adjacent the lower end of the lever 66 which is adapted for engagement with a corresponding outwardly extending protrusion 76 on the crank 54.

Lever 66 is biased in a clockwise direction by means of a lightweight helical spring 78. As best seen in FIGS. 1 and 2, the spring 78 has a helical portion disposed about the pivot 68, a leg 80 in engagement with the adjacent end wall of box 44, and a downwardly extending leg 82. The last-mentioned leg is in engagement with an ear 84 on the lever 66, so that the lever is biased in a clockwise direction.

The connection arm 50 is operatively coupled to link 56 by means of a shaft 86. The arm 50 extends from the shaft 86 and includes a yoke portion 88. The spaced arms of yoke portion 88 are adjacent the boss portion 70 of the lever 66 such that the adjusting screw 74 is disposed substantially centrally of the yoke portion 88. A cylindrical connection leg 90 is pivotally secured between the arms of yoke portion 88 adjacent the outermost ends thereof, and is in turn operatively coupled to the rod 34.

The principal differences between the switch 10 of the instant invention and that described in U.S. Pat. No. 3,562,454 are as follows. First, the J-shaped weld break lever described in the referenced patent is, in practice, formed of heavy brass. As noted above however, it has been found advantageous to form the lever 66 of the present invention of lightweight aluminum. Second, provision of the helical spring 78 for biasing the lever 66 as described above is an added feature. The significance of these differences will be pointed out hereinafter.

In use, switch 10 is typically placed in an underground vault or the like and electrically coupled within a distribution circuit, it being understood that appropriate electrical connectors are applied to the connector 46 and shaft 32 of the switch 10 for this purpose. When the contacts 28, 30 are closed, a low resistance electrical path is defined between the connector 46 and stud 32 via box 44, bushing 42, band 40, contact 38, rod 34, contacts 28, 30 and stud 32. In the closed position (see FIG. 5), it will be noted that the tension springs 58, 60 exert a force through arm 50, connector 90 and rod 34 such as to ensure a positive engagement between the contacts 28, 30.

Figure 5:
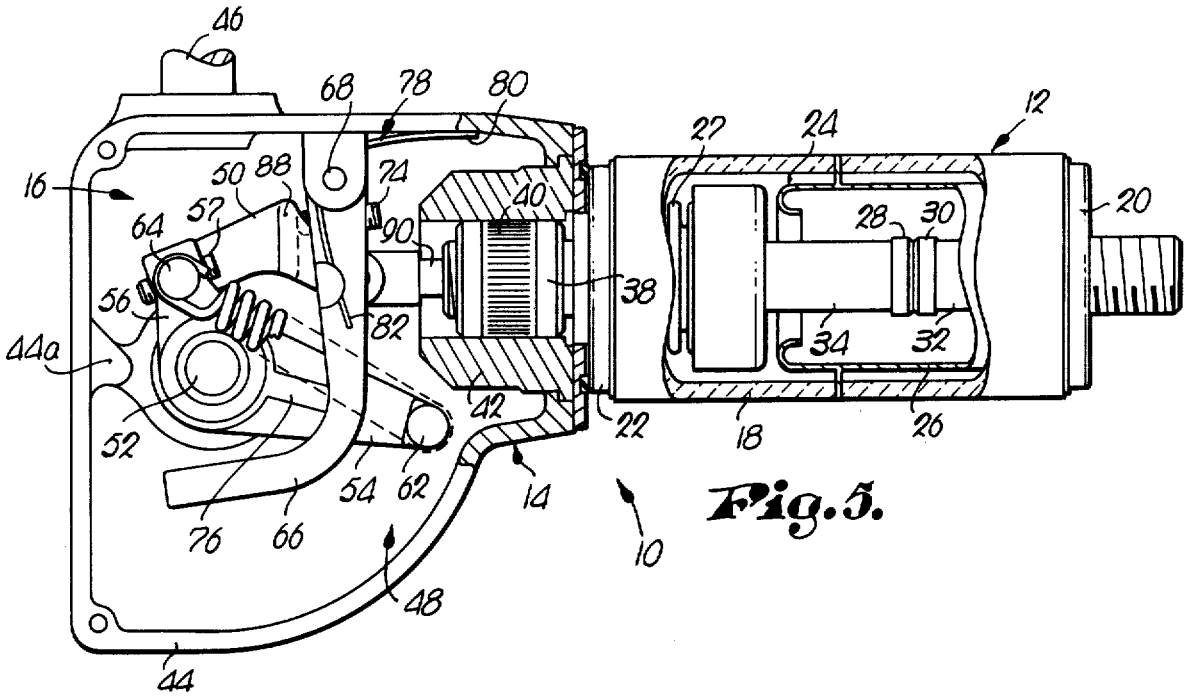
FIG. 5 is a view similar to that of FIG. 1, but showing the switch contacts in their closed position and with the switch operating apparatus in the switch closed, over center position thereof.

When it is desired to open switch 10, the operating handle 39 is rotated so as to turn shaft 52 and crank 54 in a clockwise direction as viewed in FIG. 5. Such movement continues until the crank 54 reaches its over center position whereupon the force exerted by the springs 58, 60 is reversed in direction such that arm 50, acting through connector 90 and rod 34, causes contact 28 to be quickly shifted away from the contact 30. This high velocity retractive motion continues until the screw 57 strikes abutment 44*a*.

As described in U.S. Pat. No. 3,562,454, the lever 66 serves, during the opening sequence, to ensure that the contacts 28, 30 are separated, in the event that such contacts have become welded together during use. This weld break function is accomplished in the following manner. As the crank 54 is shifted between its FIG. 5 and FIG. 1 positions, the protrusion 76 thereon engages the corresponding ear on lever 66, so that the lever is moved in a clockwise direction as viewed in FIG. 5. It will be appreciated that spring 78 in no way interferes with such movement of the lever 66, inasmuch as the bias of the spring urges the lever 66 in a clockwise direction. In any event, as the lever 66 rotates the adjustment screw 74 carried thereby comes into engagement with the yoke portion 88 of arm 50. Continued rotation of the crank 54, and thus the lever 66, thereby breaks the weld between the contacts 28, 30. If however, the extent of welding between the contacts 28, 30 is sufficiently great to prevent breaking thereof by the force applied through the lever 66, full movement of the crank 54 to the switch open position is prevented, thus precluding a situation wherein the switch is believed to be open while in fact the contacts still remain electrically connected.

Figure 3:
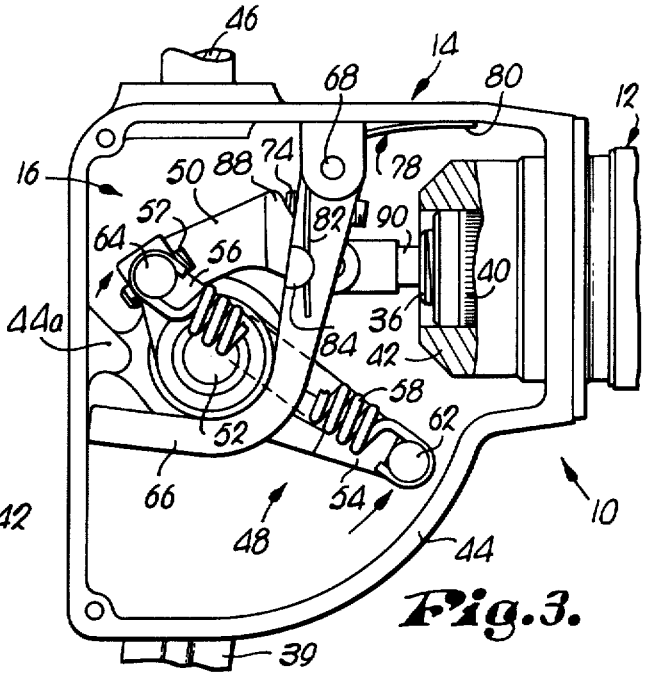
FIG. 3 is a fragmentary view with parts broken away for clarity of the switch operating apparatus, shown during the initial stages of the switch closing sequence.

When it is desired to close the contacts 28, 30, the following procedure is followed. First, the operating handle 39 for the switch is rotated in a direction to rotate the shaft 52 and crank 54 in a counterclockwise direction from the FIG. 1 position thereof to the FIG. 5 position. Here again, it will be understood that when the toggle mechanism 48 goes over center (see FIG. 3), a pushing force is exerted through arm 50, connector 90 and rod 34 to quickly close the contact 28 against stationary contact 30.

Figure 4:
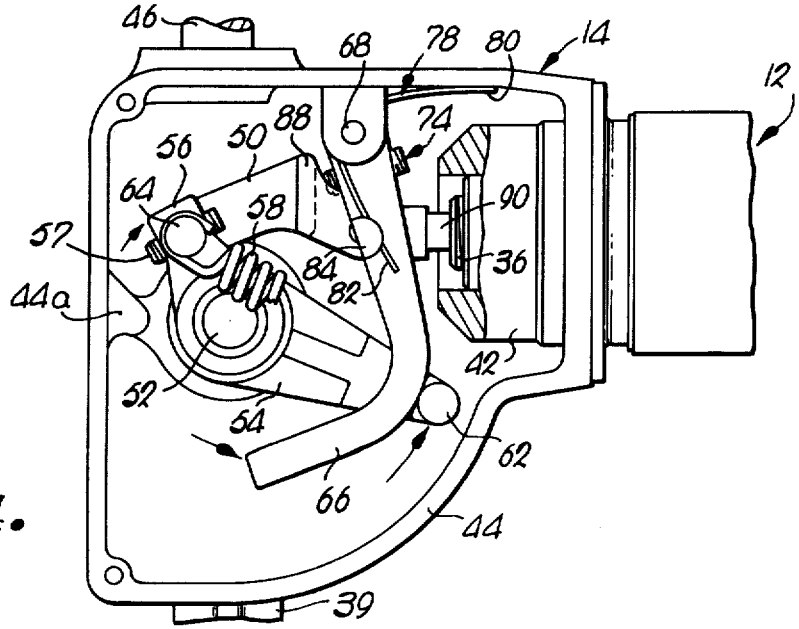
FIG. 4 is a view similar to that of FIG. 3, but illustrating the switch operating apparatus just prior to the instant of impact between the switch contacts.

As explained above, the relatively high impact force developed during switch closing can lead to significant deformation of the contact shafts. In order to prevent such deformation with the improved switch of the invention, the lightweight lever arm 66 and spring 78 come into play. Specifically, when toggle mechanism goes over center (FIG. 3) during the closing sequence, the yoke portion 88 of arm 50 engages the screw 74 and thereby imparts a rotational force to the arm 66 tending to pivot the latter in a counterclockwise direction (see arrow 92 of FIG. 4). It will be observed in this respect that such rotation of the lever arm 66 is against the bias exerted by the helical spring 78. It has been found that the lightweight spring 78, in conjunction with the low mass aluminum lever arm 66, serves to absorb a large proportion of the potentially destructive forces which otherwise would be largely absorbed by the deformable shafts 32, 34. Moreover, such shock-absorbing function occurs in a manner that the total closing time of the contacts is closely similar to the closing time of prior switches of this type. Hence, the advantage of shock absorption is not offset by a significant change in closing time for the switch. In effect, the lever 66 and spring 78 cooperatively slow the shiftable contact just prior to the instant of contact and permit a relatively cushioned "soft landing" or impact thereof against the stationary contact. Furthermore, the static closing force of the switch is unaffected by the present invention, and therefore the ability thereof to withstand momentary surges is unimpaired.

Figure 6:
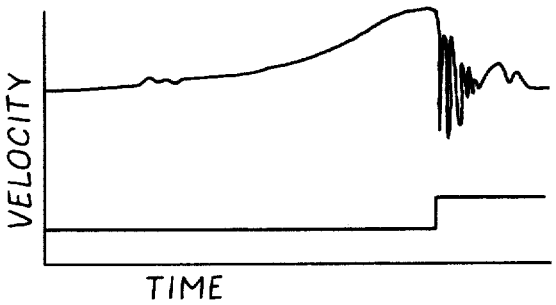
Fig. 6. PRIOR ART
FIGS. 6–8 are velocity-time characterizing graphs of the closing sequences of, respectively, a switch of the type described in U.S. Pat. No. 3,562,454; a switch of the type described in U.S. Pat. No. 3,562,454 having the usual brass weld break lever but with spring bias applied thereto; and a switch of the type described in U.S. Pat. No. 3,562,454, but with a low mass aluminum weld break lever substituted for the usual brass lever, and with spring bias applied.
Figure 7:
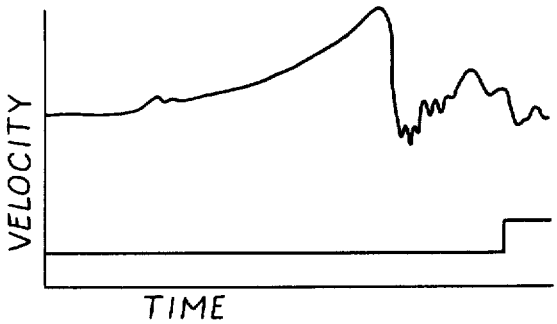
Figure 8:
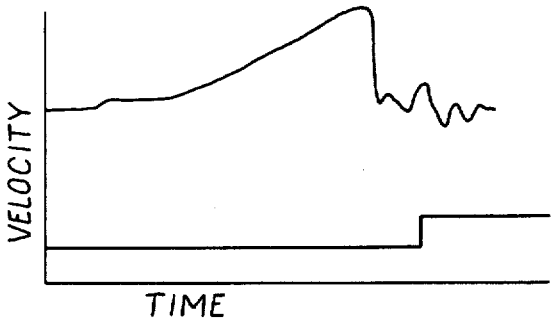

Reference is now made to FIGS. 6–8 which are a series of velocity and time graphs. FIG. 6 is a graph of a prior switch of the type described in U.S. Pat. No. 3,562,454, having the usual heavy brass weld break lever. The uppermost irregular tracing on the graph illustrates the velocity of the shiftable contact 28 during a closing sequence, whereas the lower graph is a voltage trace across the contacts, where the vertical "jump" occurs at the instant of impact between the switch contacts. As can be seen from a study of the FIG. 6 graphical representation, impact between the contacts 28, 30 is made at a time of maximum velocity; hence, the contacts and shafts therefor absorb all of the force developed by the springs 58, 60, which can lead to significant deformation of the supporting shafts 32, 34.

In another comparative test the apparatus used in the FIG. 6 test was modified by addition of the spring 78. However, the original brass weld break lever 66 was used in this test. In this instance the relatively high mass lever arm 66 actually stopped the contact 28 and created a rebound effect in the contact 28 prior to engagement with the stationary contact 30. From this test it was determined that the original brass lever arm 66 had too great a mass for use in the instant invention. In order to solve this problem, two approaches were possible. First, the cover arm could be redesigned to lower its effective mass, or a lighter weight material could be used. The latter alternative was selected, and an aluminum lever arm was employed.

The modified switch having the aluminum lever arm and spring 78 was tested in the manner of the above-described switches, and the results of these tests are given in FIG. 8. First of all, it will be seen that the time of closing represented by the lower graph line is essentially identical with the time of closing of the prior art unit (see FIG. 6). However, the velocity of the shiftable contact 28 at the instant prior to closing is substantially reduced, as compared with the FIG. 6. test. In fact, the velocity of the shiftable contact at the time of closing in the FIG. 8 test has been found to be only about one-fifth of that of the prior art unit (FIG. 6). This substantial reduction in velocity, and hence in the impact force which must be absorbed by the contacts and supporting shafts 32, 34 essentially completely eliminates the problem of shaft deformation. Thus, the heretofore employed expedient of work hardening of the contact shafts by repeated opening and closing cycles has been eliminated.

It will also be understood that the use of an aluminum lever 66 and spring 78 was resorted to because it provided an effective energy absorbing function without detracting from the desirable weld break function. In other contexts however, suitable structure of varying shapes and materials can be employed, as long as the function of impact force absorption is provided. For example, it will be appreciated that a wide variety of switch operating mechanisms are available, and that the concepts of the present invention can be incorporated therein. In such instances, the particular energy-absorbing structure employed would of necessity be engineered so as to accommodate the structure and operational characteristics of the mechanism in question.

Having thus described the invention, what is claimed as new and desired to be secured by Letters Patent is:

1. In an electrical switch including a pair of electrical contacts, soft metal, deformable shafts respectively supporting said contacts, and spring-loaded means for selective opening and closing of the contacts as desired and for creating a predetermined static closing force between said contacts when the contacts are in a closed condition, including opening and closing apparatus operatively coupled to at least one of the shafts, the improvement comprising structure for slowing the relative closing speed of said contacts prior to the instant of impact between said contacts for absorbing a part of the impact force developed during closing of said contacts, and without substantially lessening said static closing force between the contacts when the contacts are closed, said structure including an elongated arm presenting an engagement surface;

means supporting said arm for pivoting movement thereof and in a location proximal to said closing apparatus; and means associated with said arm for biasing the arm to a disposition where said surface is in the path of said closing apparatus during closing of said contacts for causing said apparatus to engage and pivot said arm immediately prior to closing of said contacts, the distance between the pivot axis of said arm and said engagement surface being substantially less than the overall length of said arm.

2. The switch as set forth in claim 1 wherein said lever arm is formed of aluminum.

3. The switch as set forth in claim 1 including vacuum bottle structure surrounding said contacts.

4. The switch as set forth in claim 1, one of said contacts being stationary, the shaft supporting said other of said contacts being coupled to said apparatus.

* * * * *